United States Patent [19]

Collins

[11] Patent Number: 5,001,834

[45] Date of Patent: Mar. 26, 1991

[54] UTILITY SHEATHING SYSTEM

[75] Inventor: Walter W. Collins, North, S.C.

[73] Assignee: Schur, Inc., West Palm Beach, Fla.

[21] Appl. No.: 535,044

[22] Filed: Jun. 8, 1990

[51] Int. Cl.[5] ..... B26B 29/02

[52] U.S. Cl. ..... 30/151; 30/162

[58] Field of Search ..... 30/162, 151, 143, 339

[56] References Cited

U.S. PATENT DOCUMENTS

| | | | |
|---|---|---|---|
| 191,063 | 5/1877 | Manuel et al. | 30/162 |
| 2,391,574 | 12/1945 | Housinger | 30/151 |

FOREIGN PATENT DOCUMENTS

| | | | |
|---|---|---|---|
| 2940057 | 4/1980 | Fed. Rep. of Germany | 30/162 |
| 908850 | 4/1946 | France | 30/151 |
| 323352 | 9/1957 | Switzerland | 30/151 |

*Primary Examiner*—Frank T. Yost
*Assistant Examiner*—John M. Husar
*Attorney, Agent, or Firm*—Wolf Greenfield & Sacks

[57] ABSTRACT

A tool and sheath combination in which the tool is securely engaged in the sheath. A release bar having a tip and a distal end is coupled to the sheath. The tool has at least one recess for accepting the tip of the release bar when the tool is fully inserted in the sheath. A flexible element coupled to the release bar biases the release bar to engage the recess when the tool is fully inserted in the sheath and a fulcrum located between the tip and the distal end of the release bar permits rotation of the release bar for disengagement from the recess under finger pressure applied to the distal end. A second surface along the tip and angled obliquely relative to the edge of the recess may continue to engage this edge after the biasing element is overcome by hand pressure to retain the tool in the sheath. This second surface, however, may be overcome by applying force to pull the tool out of the sheath.

14 Claims, 2 Drawing Sheets

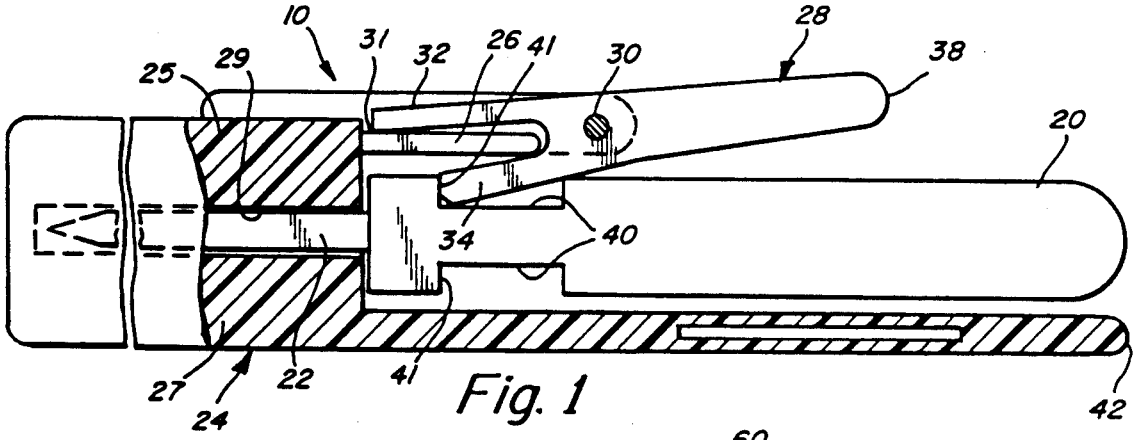
Fig. 1
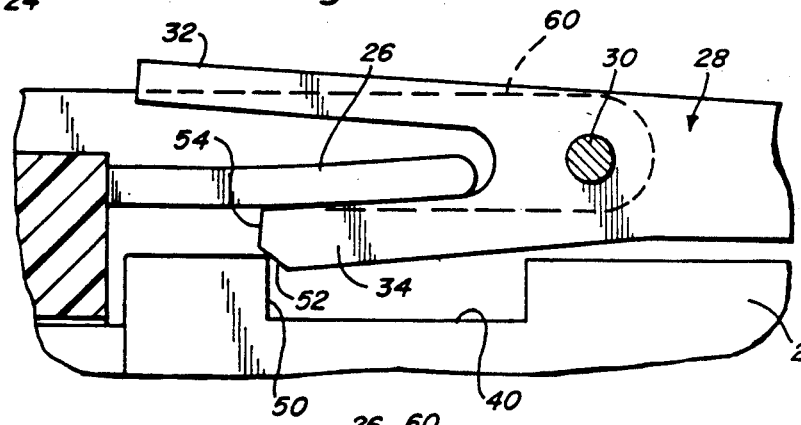
Fig. 2
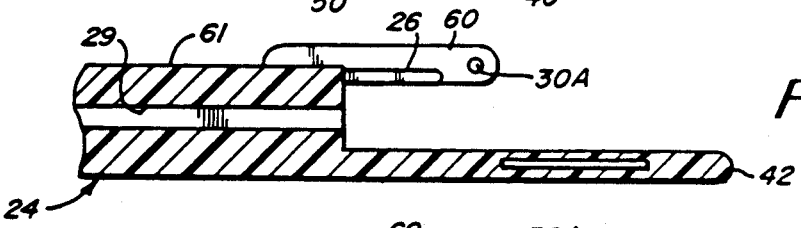
Fig. 3
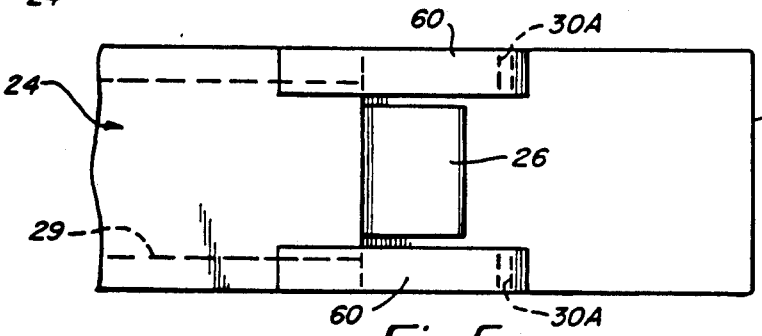
Fig. 4
Fig. 5
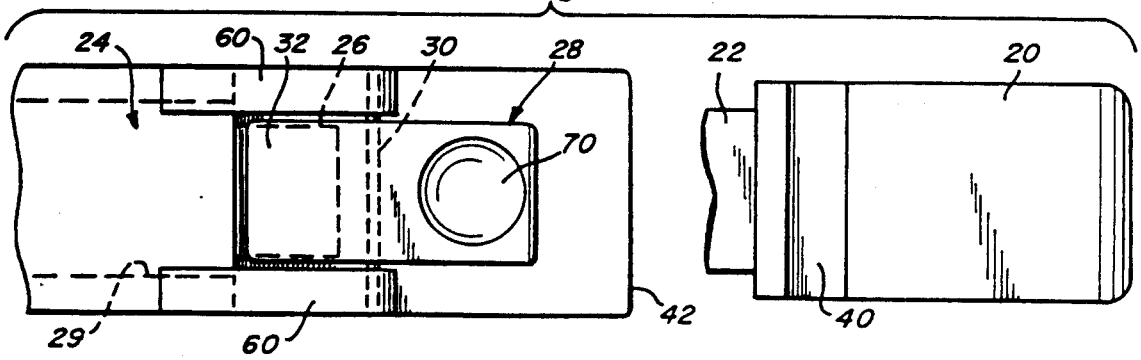

UTILITY SHEATHING SYSTEM

FIELD OF INVENTION

This invention relates to a tool and sheath combination having an improved means for retaining the tool in the sheath until release pressure is positively applied.

BACKGROUND OF INVENTION

It is often advantaqeous to engage a knife or other tool in a sheath in a way that prevents the tool from slipping from the sheath. One solution for this problem has been to tie the tool to the sheath with a strap or snap device. However, it is difficult to retrieve such a tied down tool quickly, especially under adverse conditions such as in an underwater environment.

Other devices have used specially adapted tool handles and coil spring loaded locking buttons, with a variety of parts mounted in the sheaths to engage the tool handles. A variety of such tool and sheath locking combinations relating particularly to knives are disclosed in U.S. Pat. Nos. 4,404,747, 4,854,044 and 4,856,192. Although these devices are adequate to retain a tool in a sheath, they are costly to manufacture and assemble and may also jam or deteriorate under adverse environmental conditions. These previous devices also frequently involve very specifically shaped features on the tools. Additionally, unsheathing operations utilizing the systems of these prior disclosures are still somewhat slower to unsheath than optimally desired since the user must press a relatively small location on the sheath while simultaneously pulling upon the tool handle.

SUMMARY OF INVENTION

It is, therefore, an object of this invention to provide a tool and sheath combination that allows positive locking of a tool to a sheath while insuring rapid removal of the tool when needed.

A further object of this invention is to provide a tool and sheath combination with a relatively liqhtweight and compact locking and removal system.

A further object of this invention is to provide a tool and sheath combination with a locking and removal system incorporating a relatively small number of moving parts that are rugged and not prone to damage from adverse environmental conditions.

A further object of this invention is to provide a tool and sheath combination that is constructed with few parts and is simple to manufacture and assemble.

A further object of this invention is to provide a tool and sheath combination that allows rapid location of the release mechanism for quicker removal of a tool, even under adverse conditions.

It is yet another object of this invention to provide a tool and sheath combination that may be used in conjunction with a wide variety of conventionally available tools with relatively minor alteration to the handles or other components.

The present invention provides an improved tool and sheath combination having means for securely engaging the tool. A release bar having a tip end and a distal end is coupled to the sheath. The tool has at least one recess for receiving the tip of the release bar when the tool is fully inserted in the sheath. The release bar is biased to engage the recess of the tool when the tool is fully inserted in the sheath. A fulcrum located between the tip and the distal end of the release bar permits rotation of the release bar for disengagement from the tool under hand pressure at the distal end.

In a preferred embodiment, the tip of the release bar may include a first surface which engages on one edge of the recess to lock the tool in the sheath under the force of the biasing means. The tip may also include a second surface positioned to engage the edge of the recess when the force of the biasing means is overcome by hand pressure. This second surface is angled obliquely relative to the recess edge so that the second surface tends to retain the tool in the sheath. However, the second surface can be disengaged by pulling the tool out of the sheath. The release bar may be resilient and the tool may be a knife. This knife may have a handle with two recesses positioned on opposing surfaces. The release bar and the biasing means may also be constructed of a plastic material. The biasing means may comprise a leaf spring that contacts and applies force to the tip of the release bar. This leaf spring may comprise a length of flexible material integrally molded with and projecting from the sheath. The release bar may comprise a pair of legs with the outer leg having stop means engaging the outer face of the leaf spring. The stop means contacts this outer face when the release bar is at a predetermined pivot angle. The distal end of the release bar preferably is shaped to conform to a gripping hand.

BRIEF DESCRIPTION OF THE DRAWINGS

The foregoing objects and advantages of the present invention will be more clearly understood in connection with the accompanying drawings in which:

FIG. 1 is a cross-sectional schematic illustration of a tool and sheath combination including a tool handle locking mechanism according to this invention;

FIG. 2 is an enlarged detailed cross-sectional diagram of the tool handle locking mechanism of FIG. 1;

FIG. 3 is a somewhat schematic cross-section of a sheath with the tool and the handle locking release bar removed;

FIG. 4 is a top view of the sheath of FIG. 3;

FIG. 5 is a top view of the sheath of FIG. 1 with the tool removed;

DETAILED DESCRIPTION OF THE PREFERRED EMBODIMENT

Figures 6A, 6B, 6C, 6D, 6E, 6F, 6G, 6H:
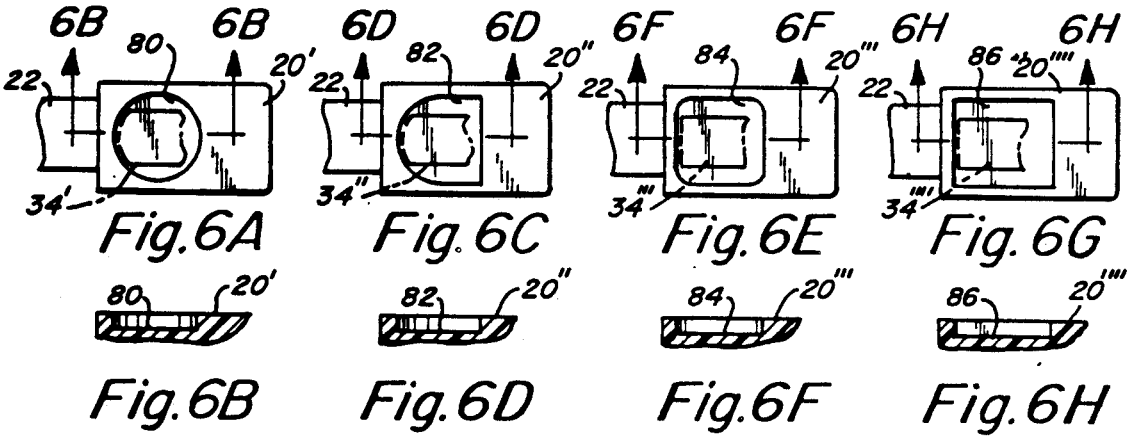
FIGS. 6A, 6C, 6E and 6G are fragmentary details of four alternate recess shapes that may be formed on a tool handle for use with this system.
FIGS. 6B, 6D, 6F and 6H are cross-sectional details taken on corresponding worked lines respectively in FIGS. 6A, 6C, 6E and 6G.

The sheath and tool combination 10 shown in FIG. 1 consists of a sheath 24 with a belt end 42, a tool 22, which in this example is a knife having a handle 20, and a release bar 28 that pivots about a shaft 30. The knife blade 22 may be of conventional design with the handle 20 conventionally formed. The knife blade may be conventionally formed with one end molded in the handle 20. The handle 20 is formed with a pair of recesses 40 on opposite faces of the handle. Preferably, these recesses 40 extend transversely across each face and are formed with well defined shoulders 41 at the end of the recesses closest to the blade 22. To aid the construction of the recesses, the handle may be constructed with generally flat sides.

The sheath 24 may be made of suitable material such as leather or durable plastic in a variety of forms and colors with opposite walls 25 and 27 appropriately formed at the peripheral sides and the bottom to define an opening 29 of sufficient size to receive the blade 22. The shaft 30 is supported by a pair of supports 60 (FIGS. 4 and 5). These supports 60 are spaced apart on either side of the sheath opening 29 and are secured rigidly at one end to the sheath with the shaft 30 extending therebetween and pivotally supporting the release bar 28. The release bar 28 has two parallel legs 32 and 34 on one side of the shaft 30 and a lever or distal end 38 extending from the shaft in the opposite direction. A leaf spring 26 is secured at the upper end of the sheath wall 25 and projects between legs 32 and 34. The belt end 42 is suitably shaped and provided with a slot through which a belt may pass.

The tip of the release bar lower leg 34 locks into the recess 40 in the handle 20 in a normal position as illustrated in FIG. 1 when there is no hand pressure on the release bar 28. The leaf spring 26 maintains a constant force on the leg or tip 34 to normally secure it in the recess 40. The engagement of the leg 34 with the recess 40 locks the handle into the sheath preventing the tool from inadvertent withdrawing. Hand pressure on the lever or distal end 38 of the release bar rotates the legs 32 and 34 about the pivot point 30 against the normal tension of spring 26 to disengage the tip 34. This pivoting disengages the leg 34 from the recess 40 and frees the handle for removal.

An advantage of this design is that user may grip both the tool handle and the elongated release bar simultaneously and, in one movement, remove the tool from the sheath while also applying pressure to the release bar. Because the release bar is parallel to and adjacent the handle, the bar is as quickly and easily located as the handle itself.

The sheath construction which, as shown in FIG. 3, may integrally include the leaf spring 26 and release bar supports 60 with aligned pivot point holes 30A in which the ends of a metal shaft 30 are secured. The shaft may be constructed of stainless steel. The leaf spring is an extension of the sheath top panel 61 and is generally planar in shape.

An additional feature of this embodiment, as shown in FIG. 2, is the secondary locking action of the release bar tip to prevent accidental withdrawal of the tool even if inadvertent pressure is applied to the release bar. The release bar lower leg or tip 34, when rotated to a partial release position from a secure or lockup position, still rests partially within the handle recess 40. This is due to the clearance between spring 26 and handle 20 which is slightly less than the thickness of tip 34 in a normal unstressed position. Although the fully locking vertical tip surface 54 (FIG. 2) is no longer aligned with the recess surface 50, an obliquely angled surface 52 still remains in contact with the recess surface 50. Therefore, as the handle 20 is withdrawn, it encounters resistance pressure due to contact between the recess surface 50 and the angled release bar surface 52. Thus, two distinct motions are required to remove the tool. First, the release bar must be rotated by squeezing the distal end toward the tool handle, and at the same time, the tool must be pulled outwardly with sufficient force to overcome the emitted resistance of surface 52 against 50. The resistance is proportional to the elasticity of various components including supports 60, spring 26 and the release bar tip 34, as well as the angle of tip surface 52 relative to the recess surface 50. Since the release bar is preferably constructed of plastic, the release bar and spring are sufficiently resilient to provide a significant resistance to withdrawal without incurring permanent deformation.

The top leg 32 of the release bar forms a stop to limit the release bar's free pivoting, as depicted in FIG. 1. The maximum free pivoting of the release bar is limited to the point at which the stop contacts the opposite face 31 of the leaf spring 26.

The integral design of the sheath allows expedited manufacturing and ease of assembly of the system since the release bar 28 is the only moving part. The pivot point holes 30A in each release bar support 60 may have a slightly undersized diameter relative to the stainless steel shaft 30. This permits a tight press fit of the shaft into the supports to hold the shaft in place. Similarly, the diameter of the hole in the release bar, through which shaft 30 passes, may be slightly oversized to allow free pivoting of the bar about the shaft. Since the release bar supports 60 protrude above the top panel 61 of the sheath, the release bar is prevented from moving from side to side. The release bar, at its distal end, may also include a shaped surface 70 that allows better grip on the locking mechanism while withdrawing the tool.

The tool may have recesses 40 in each side of the handle to permit its insertion and withdrawal with either face of the handle adjacent the release bar. The recesses in the handle may take a variety of forms as long as the tip 34 of the release bar is properly shaped to conform with the recess and provides an interfering fit on interengagement. FIGS. 6A, 6C, 6E and 6H depict a number of alternative top views for recesses placed upon the handle. FIGS. 6B, 6D, 6F and 6H similarly depict the corresponding cross-sectional side views for these recesses. The recess in the handle may be circular 80 (FIGS. 6A and 6B), part rectangle with a semi-circular side 82 (FIGS. 6C and 6D), a rectangle with rounded corners 84 (FIGS. 6E and 6F), or a true rectangle 86 (FIGS. 6G and 6H). The size and dimensions of this recess may be varied to conform with the type and size of handle being used. Each tip 34'-34'''. has been shaped so that its end corresponds to the respective recess shape. Preferably, the recess should be shaped to permit easy interengagement with the locking bar.

It should be understood that the preceding is merely a detailed description of a preferred embodiment. It will be apparent to those skilled in the art that various modifications can be made without departing from the spirit or scope of the invention. The preceding description is meant to describe only a preferred embodiment and not to limit the scope of the invention.

What is claimed is:

1. A tool and sheath combination comprising:

a tool having a handle and a working element;

a sheath for securely engaging said working element of said tool with said handle projecting therefrom;

a release bar having a tip end and a distal end coupled to said sheath;

at least one recess on said handle for accepting said tip of said release bar when said tool is fully inserted in said sheath;

flexible biasing means coupled to said release bar for biasing said release bar to engage said recess when said tool is fully inserted in said sheath; and fulcrum means located between said tip and said distal end of said release bar that permits rotation of said release bar for disengagement from said recess under hand pressure applied to said distal end to bias said distal end toward said handle.

2. A tool and sheath combination as set forth in claim 1 wherein said tip comprises a first surface which engages on an edge of said recess to lock said tool to said sheath under the force of said biasing means and a second surface positioned to engage said edge of said recess when the force of said biasing means is overcome by hand pressure and angled obliquely relative to said edge whereby said second surface retains said tool in said sheath but can be disengaged by applying force to pull said tool out of said sheath.

3. A tool and sheath combination as set forth in claim 2 wherein said release bar is resilient.

4. A tool and sheath combination as set forth in claim 3 wherein said tool is a knife.

5. A tool and sheath combination as set forth in claim 4 wherein said knife comprises a handle having two of said recesses disposed upon opposing surfaces of said handle.

6. A tool and sheath combination as set forth in claim 1 wherein said release bar and said biasing means are constructed of a plastic material.

7. A tool and sheath combination as set forth in claim 1 wherein said biasing means comprises a leaf spring means in contact with and applying force to said tip.

8. A tool and sheath combination as set forth in claim 7 wherein said leaf spring is a length of flexible plate material molded into said sheath.

9. A tool and sheath combination as set forth in claim 7 wherein said release bar includes a stop means positioned to contact the opposite face of said leaf spring from the face contacting said tip when the release bar attains a predetermined pivot angle.

10. A tool and sheath combination as set forth in claim 1 wherein said distal end includes a surface shaped to conform to a griping hand.

11. A tool and sheath combination having means for securing the tool in the sheath in the absence of a positive manually applied force comprising:

a tool having a handle and working element and a sheath having an opening shaped and sized to receive said working element with the handle projecting therefrom;

lever means having a tip and a distal end and an axis perpendicular to the length of said tool about which said lever means pivots secured to said sheath in longitudinal alignment with said sheath opening;

means in part formed on said tip of said lever means and said handle for engaging and interlocking said handle and said lever means together; and spring means engaging and normally retaining said handle and said tip of said lever means in said interlocked position until said distal end of said lever means is pivoted toward said handle against the spring tension of said spring means out of said interlocking position by a force applied to said lever means.

12. A tool and sheath combination as set forth in claim 11 wherein said means for engaging and interlocking includes means for resisting withdrawal of said tool from said sheath when said lever means is pivoted out of said interlocking position, said tool being withdrawable from said sheath by applying pulling force against said means for resisting.

13. A tool and sheath combination having means for securing the tool in the sheath in absence of a positive manually applied force comprising:

a tool having a handle and working element and a sheath having an opening shaped and sized to receive said working element with the handle projecting therefrom;

means in part on said handle of said tool and on said sheath securing said tool in said sheath said securing means including elements providing secure and partial release positions wherein said tool may not be removed from said sheath when said elements are in a secure position and may be removed under a positive applied force only when said elements are in a partial release position; and means for selectively moving said elements between said secure and partial release positions, said partial release position being attained when a grasping force is applied to move said elements of said securing means toward said handle.

14. A tool and sheath combination as set forth in claim 13 wherein a first and second motion are required to withdraw said tool from said sheath, said first motion including displacing said means for selectively moving from said secure to said partial release position and said second motion including pulling on said handle outwardly from said sheath with sufficient force to overcome said securing means in said partial release position.

* * * * *